United States Patent [19]

Fiddler

[11] Patent Number: 4,922,626

[45] Date of Patent: May 8, 1990

[54] PIZZA DELIVERY CONTAINER AND METHOD

[75] Inventor: R. Charles Fiddler, Lexington, Tenn.

[73] Assignee: Kolpak Manufacturing Company, Selmer, Tenn.

[21] Appl. No.: 150,432

[22] Filed: Jan. 29, 1988

[51] Int. Cl.[5] ..... F26B 21/06

[52] U.S. Cl. ..... 34/80; 34/90

[58] Field of Search ..... 34/80, 81, 90, 71; 55/281, 388

[56] References Cited

U.S. PATENT DOCUMENTS

| | | | |
|---|---|---|---|
| 2,517,537 | 8/1950 | Anderegg | 34/81 X |
| 2,920,393 | 1/1960 | Liljenstrom . | |
| 3,034,221 | 5/1962 | Tuck et al. . | |
| 3,266,170 | 8/1966 | Lawrence | 34/90 |
| 3,270,428 | 9/1966 | Van Olphen . | |
| 3,335,846 | 8/1967 | Mills . | |
| 3,721,803 | 3/1973 | DeStefano . | |
| 4,119,195 | 10/1978 | Widener . | |
| 4,134,004 | 1/1979 | Anderson et al. . | |
| 4,152,842 | 5/1979 | Laughlin . | |
| 4,224,743 | 9/1980 | Erickson et al. . | |
| 4,256,770 | 3/1981 | Rainey . | |
| 4,260,060 | 4/1981 | Faller . | |
| 4,307,519 | 12/1981 | Sziics et al. . | |
| 4,441,626 | 4/1984 | Hall . | |
| 4,497,406 | 2/1985 | Takenashi . | |
| 4,567,341 | 1/1986 | Brown . | |
| 4,677,764 | 7/1987 | Cerny . | |

*Primary Examiner*—Henry A. Bennet

*Attorney, Agent, or Firm*—Mason, Fenwick & Lawrence

[57] ABSTRACT

A pizza delivery container has a movable top and a bottom tray. A motor-driven fan is provided in the tray to circulate air through a dessicant cartridge. A food product which emits moisture, such as a pizza, is in a perforated box in the container and will have the emitted moisture removed.

A method of transporting pizza comprises placing heated pizza in a box and limiting the moisture accessible to the pizza crust, as by removing moisture by a dessicant.

18 Claims, 2 Drawing Sheets

PIZZA DELIVERY CONTAINER AND METHOD

BACKGROUND OF THE INVENTION

The present invention relates to a container, specifically for the delivery of pizza, and to a related method.

There has developed in recent years a system for marketing pizza in which pizza is delivered from the producer of the pizza, such as a pizza parlor, to the consumer. Delivery is typically made in an automobile with one or more pizzas in individual boxes carried by the delivery person in the automobile.

Pizzas are provided in paperboard boxes which, while not hermetically sealed, nevertheless retain in the box and in the pizza a substantial amount of moisture. The pizza itself will be understood to contain a substantial amount of moisture, and when cooked, some moisture is driven out of the pizza by the heat therein. The component of the pizza with the greatest moisture content is the tomato sauce, with certain toppings also having relatively high moisture content. In contrast, the dough forming a part of the pizza, while containing some moisture, has considerably less moisture content immediately after baking of the pizza. During transportation of the hot pizza, the sauce and other high-water content components emit moisture, which is substantially trapped within the box in which the pizza is delivered, and this moisture is absorbed, at least in part, by the pizza dough, now in the form of a baked crust. Continued exposure of the pizza dough or crust to the emitted moisture results in the crust absorbing emitted moisture, so that it tends to become soggy, being no longer in the crisp state it was in after baking. Consequently, when pizza is delivered in the conventional manner, within the paperboard boxes, it often is delivered with the crust having become soggy, and is substantially different in texture and taste appeal from the state it was in when removed from the oven.

Another factor tending to unsatisfactorily affect the condition of the pizza is the addition of moisture to the bottom of the box from the pizza. The moisture tends to soak the bottom of the paperboard pizza box, in some cases resulting in adherence of the pizza crust to the box bottOm, and with the risk of imparting a "cardboard" taste to the pizza.

SUMMARY OF THE INVENTION

A container is provided for the delivery of pizza which comprises a compartment for holding a pizza box with a pizza therein, and further comprising a duct with a blower in it, the duct also having therein a dessicant cartridge for removing moisture. There may also be provided in the duct a heater for heating air circulated by the blower, and a filter, such as a charcoal filter, for removing odorous gases. The pizza box is provided with openings, which communicate with the air duct, so that air is circulated through the pizza box, and through the air duct and the dessicant therein to remove moisture emitted from the pizza. The dessicant and the filter are provided as cartridges which are releasably held so that they may be removed, for renewal or replacement. The blower is driven by an electric motor which, together with the heater, are connected to a plug for insertion into the conventional automobile cigarette lighter socket. In addition, there may be provided within the pizza box a porous or ducted support, such as a corrugated element, for permitting passage of air beneath the bottom of the pizza.

Among the objects of the present invention are an apparatus and method for limiting the amount of moisture absorbed by the crust of a heated pizza during delivery thereof.

Another object of the present invention is to provide a container which will circulate air over a pizza in a container, and remove moisture and/or odorous gases from the pizza.

Yet another object is to provide a container for pizza delivery in which air is circulated to and from the pizza, dried and heated.

Still another object is to provide apparatus for causing relatively dry air to flow in contact with a major portion of the bottom of a heated pizza during delivery thereof.

Other objects and many of the attendant advantages of the present invention will be readily apparent from the following specification, the drawings and the appended claims.

DESCRIPTION OF THE PREFERRED EMBODIMENTS

Figure 1:
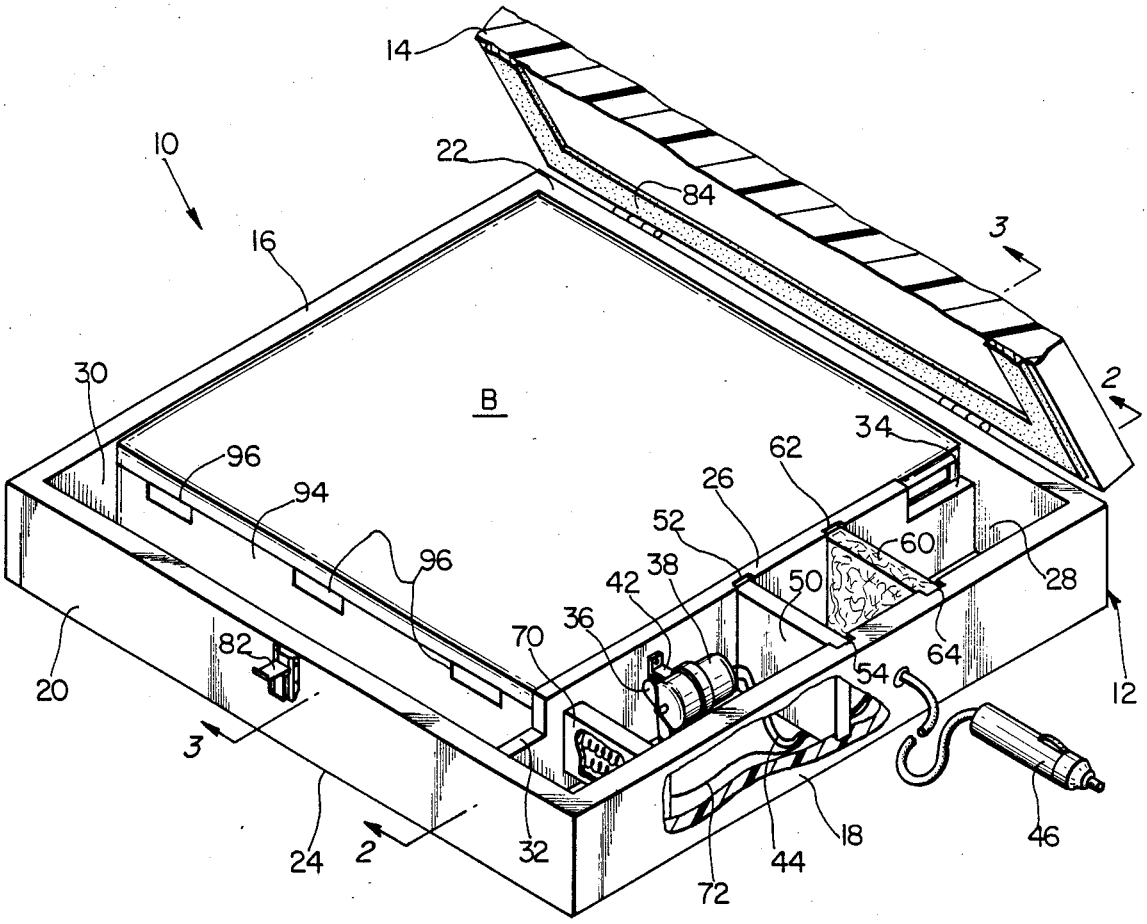
FIG. 1 is a perspective view, with parts removed, of a container for delivering pizza in accordance with the present invention.

Referring now to the drawings, wherein like or corresponding reference numerals are used for like or corresponding parts throughout the several views, there is shown in FIG. 1 a perspective view of a container 10 for holding pizza during delivery thereof, the container 10 comprising a tray 12 and a lid 14. The tray 12 comprises a pair of spaced sidewalls 16 and lB a front wall 20 and a rear wall 22. As shown, the sidewalls 16 and 18 are in spaced apart parallel relationship, as are the front and rear walls 20 and 22. A bottom 24 (see also FIG. 2) is located and connected to the sidewalls 16, 18 and front and rear walls 20 and 22 to form the tray 12. The tray 12 and lid 14 are formed of or comprise insulating material. Thus, the container 10 may have the walls, etc. thereof made of a sandwich construction provided by metal skins between which lie plastic foam insulating material, or may be of formed of plastic material, preferably including cellular material, for insulation purposes. The container 10 is generally of parallelepiped shape, when the lid 14 is closed.

Within the tray 12 is a divider wall 26 which is in spaced parallel relationship to the sidewalls 16 and 18, being near to the sidewall 18. An air duct 28 is formed by the divider wall 26, sidewall 18, and portions of the bottom 24 and lid 14. Between the divider wall 26 and the sidewall 16, there is a compartment 30 in which is shown a box B containing a pizza within it. As will be understood, although a single pizza box B is shown in the figures of the drawings, the size of the container 10 may be such as to contain one or more pizza boxes B.

To provide for communication between the compartment 30 and the duct 28, openings 32 and 34 are provided in divider wall 26 adjacent the ends thereof: as shown, the openings are in the form of notches in the upper parts of divider wall 26 adjacent the ends thereof, although other forms of openings may be provided.

To effect circulation of air between the duct 28 and the compartment 30, there is provided a blower 36 driven by an electric motor 38, supported in the duct 28 by support 42. Conductors 44 extend from the motor 38, and through the sidewall 18, to a plug-connector 46 for insertion into the cigarette lighter receptacle of an automobile. As will be understood, if desired a separate battery may be provided, instead of the disclosed plug-connector 46.

A dessicant cartridge 50 (see FIG. 2) is releasably mounted in the duct 48 by facing slots 52, 54 in the divider wall 26 and the sidewall 18, respectively. The dessicant cartridge 50 is preferably of the type which may be renewed by baking, or it may be discardable. Although a single dessicant cartridge 50 is shown, additional such dessicant cartridges may be provided.

A filter 60, such as of charcoal, is releasably supported in opposed slots 62 and 64 in the divider wall 26 and sidewall 18, respectively. The filter 60 is provided to absorb odorous gases and/or aromas emanating from the pizza within the box 20, so as to avoid the mixing or transference of flavors or aromas from one pizza to another, either by pizzas which are successively transported in the container 10 or pizzas which are simultaneously transported therein. As will be appreciated, the slots 52 and 54 slidingly hold the dessicant cartridge 50 and the slots 62 and 64 slidingly hold the filter cartridge 60, for easy replacement. As is apparent from FIG. 1, the dessicant cartridge 50, which serves to remove moisture from the air stream flowing in the duct 28, and the filter cartridge 60, which removes odors and aromas from the air stream, both are not only releasably held for removal and replacement, but in addition span the space between the divider wall 26 and the exterior wall 18.

Also provided in the duct 28 is a heater 70, connected by a conductor 72 to the plug-connector 46, conductor 72 extending through the wall 18. The heater 70 may incorporate a thermostat (not shown). Switches for the motor 38 and heater 70 may also be provided.

Figure 2:
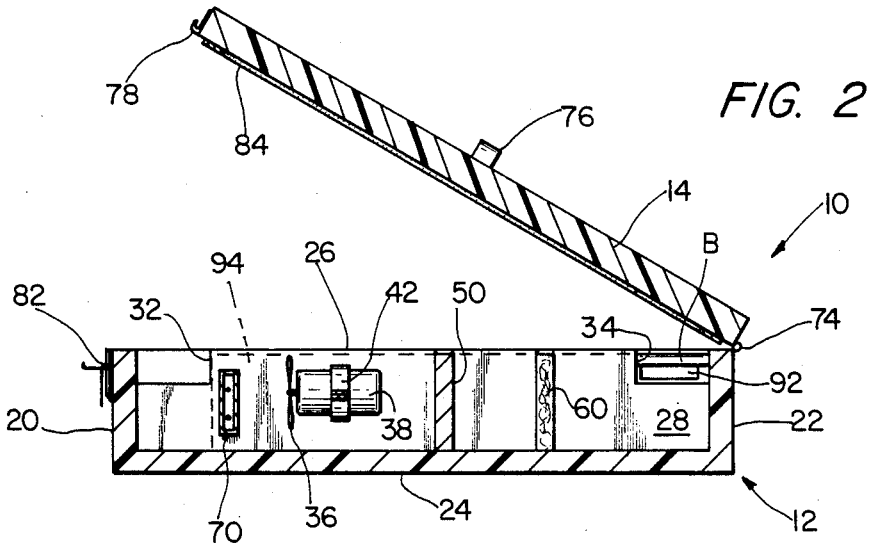
FIG. 2 is a cross-sectional view taken on the line 2—2 of FIG. 1.

Referring now to FIG. 2, there may be seen the container 10, including the lid 14, and the tray 12. The lid 14 is connected to the tray 12 by hinge 74. Lid 14 may be provided with a handle 76, and with a hook 78 at the front thereof for engagement by a latch 82 positioned on the front wall 20 of the tray 12. The walls of the tray 12, including the exterior sidewalls 16 and 18, the front wall 20 and the rear wall 22, as well as divider wall 26, are of substantially the same height, and the bottom of the lid 14 is provided with a gasket 84 to provide sealing engagement of the lid 14 and tray 12. There is also shown in FIG. 2 the bottom 24 of tray 12, together with the duct 28 in which are located the filter 60, dessicant cartridge 50, blower 36 and motor 38, as well as heater 70. The divider wall 26 is shown with the openings 32 and 34 therein, and behind the divider wall 26 is the pizza box B. In the box B, in juxtaposition with the opening 34, is an opening 92. The front wall 94 of box B will be seen to be in spaced relationship to the inner face of the front wall 20 of the tray 12, so as to provide a passage between the front wall 92 of box B and front wall 20 of tray 12. The front wall 94, as shown in FIG. 1, has openings 96 for admitting air into the pizza box B. Thus, the blower 36 causes air to flow along the duct 28, towards the front wall 20, through the opening 32 and into the passage formed by the interior front wall 20 of tray 12 and the exterior of front wall 94 of pizza box B, thence into the pizza box B, leaving the pizza box B through the opening 92, and re-entering the passage 28, to provide circulation from within the box B to the dessicant cartridge 50 and to the optionally provided filter 60 and heater 70.

Figure 3:
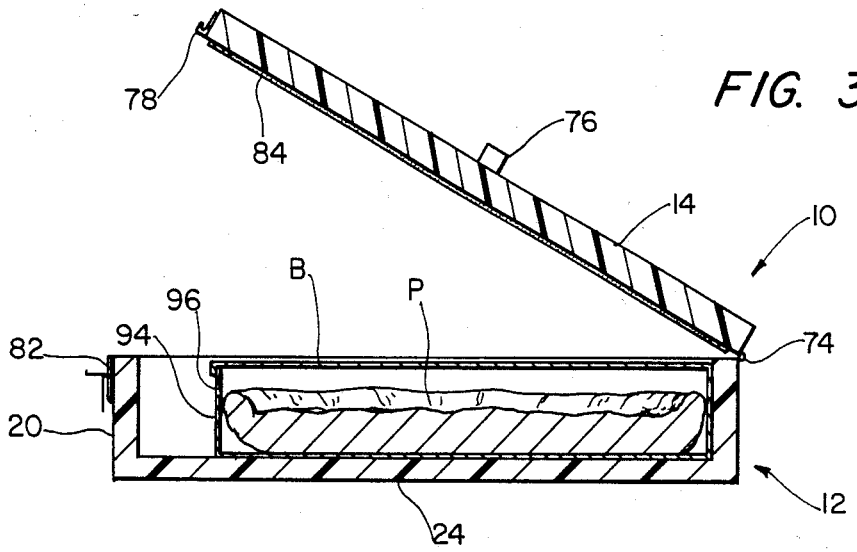
FIG. 3 is a cross-sectional view taken on the line 3—3 of FIG. 1.

Referring to FIG. 3, there may be seen the box B with the heated pizza P within it, including the front wall 94 of box B spaced from the interior surface of the front wall 20 of the tray 12. There is also shown one of the openings 96 through which air enters from the noted passage.

Figure 4:
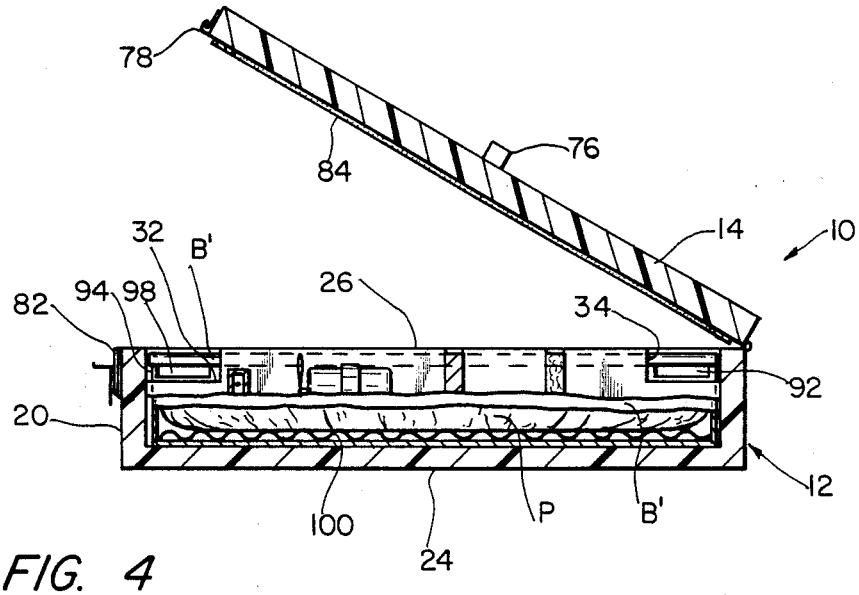
FIG. 4 is a cross-sectional view similar to FIG. 2, and showing a different pizza container than that shown in FIGS. 1–3.

In FIG. 4, there is shown an alternate embodiment in which the pizza box B′ has the front wall 94 thereof closely adjacent to the inner surface of the front wall 20 of the tray 12. There is provided in the sidewall of the box B′ adjacent to the divider wall 26 an opening 98 which is in alignment with the opening 32, to thereby provide circulation between the interior of box B′ and the duct 28.

Figure 5:
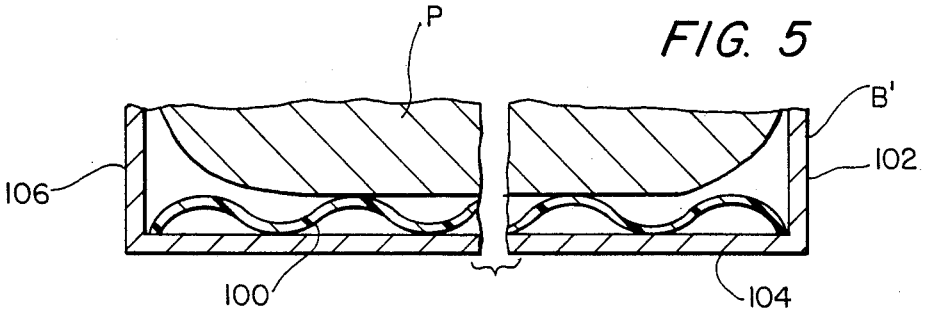
FIG. 5 is an enlarged cross-sectional view, with parts broken away, of a box and pizza as shown in FIG. 4.

In order to provide for even greater crispness of the pizza P within the box B′, there is provided a flow-permitting spacer 100 on the bottom of the box B′, upon which the pizza P rests. This construction is shown in the enlarged cross-sectional view shown in FIG. 5, in which there is shown the box B′ with rear wall 102, bottom 104 and front wall 106, with the pizza P therein resting upon the spacer 100. Spacer 100 is preferably in the form of a corrugated element providing passages between it and the bottom of the pizza P, so that air may flow in the passages and remove moisture from the crust of the pizza P. As will be understood, the spacer 100 may be utilized in a box B as shown in FIGS. 1-3.

The spacer 100 is of a material which is preferably non-heat conducting, and non-moisture absorbing. For example, a plastic material, such as high density plastic, may be utilized for the production of the spacer 100.

In accordance with the present invention, a pizza is prepared, including or consisting of the step of baking it, usually upon receipt of a telephonic order. A box such as the box B or the box B′ is provided, and the pizza while at heated, super-ambient temperature, is placed in the box B or B′ and the box is then closed. Preferably, prior to placement of the pizza in the box, there has been placed into the bottom of the box a separator 100, or other element or elements for permitting the passage of air between the bottom of the pizza and the box. The heated pizza will emit moisture, particularly from the tomato paste and other high-moisture content portions of the pizza, the pizza dough or crust being of a substantially lower moisture content. The amount of moisture which reaches the pizza dough or crust is substantially limited, so that there is thereby a significant diminution of the amount of moisture, emitted by the pizza, into the pizza crust, thereby preventing the crust from becoming or approaching a soggy state, enabling the crust to remain crisp. This is accomplished by the placement of the pizza box B or B′, with the pizza P in it, into the container 10, and transporting the loaded or filled container 10 in an automobile or other conveyance with energization of the electric motor, as by utilization of the plug-connector 46 and the cigarette lighter receptacle of the automobile. This causes air to be recirculated between the interior of the box B or B′ containing the pizza P and a moisture retainer, specifically a dessicant cartridge as herein disclosed.

There has been provided a method and apparatus for maintaining the dough of a pizza in crisp condition while delivering the pizza in a heated state. The herein provided method and apparatus provide for the limiting of the amount of moisture, emitted from the pizza, which is absorbed by the crust of the pizza. This is effected by placing the pizza in a box and limiting the access of moisture to the pizza crust, as by circulating the air within the pizza box to and from a drier for the air. Further, there has been disclosed herein the provision of a heater for heating air returning to a pizza box, as well as a filter for removing odorous gases and aromas from the air stream delivered to the interior of a pizza box. In addition, there has been provided a pizza box in combination with a spacer element for limiting the contact of a supporting element for a pizza with the bottom of the pizza, and for providing passageways for air adjacent to the bottom of the pizza.

The claims and the specification describe the invention presented, and the terms that are employed in the claims draw their meaning from the use of such terms in the specification. Some terms employed in the prior art may be broader in meaning than specifically employed herein. Whenever there is a question between the broader definition of such terms used in the prior art and more specific use of the term herein, the more specific meaning is meant.

What is claimed is:

1. A container for the delivery of pizza comprising:

a plurality of peripheral walls, a top and a bottom, means for defining a duct in said container comprising:

(i) a divider wall in said container spaced from a said peripheral wall, (ii) at least a portion of said last mentioned peripheral wall, and (iii) portions of said top and bottom, means in said duct for holding desiccant, a compartment in said container adjacent said duct defined by portions of said top and bottom, peripheral walls and said divider wall, means for circulating air through said duct and through desiccant held in said holding means, and means comprising spaced passages in said divider wall for communicating said compartment and said duct for enabling circulation of air between said duct and said compartment.

2. The container of claim 1, said container peripheral walls, top and bottom comprising insulating material.

3. The container of claim 1, said circulating means being in said duct.

4. The container of claim 3, said dessicant holding means holding dessicant in said duct.

5. A container for the delivery of pizza comprising:

a duct, means in said duct for holding desiccant, means in said duct for circulating air through said duct and through desiccant held in said holding means, a compartment adjacent said duct, means for communicating said compartment and said duct, and said container comprising at least one exterior linear wall, and internal wall in spaced relation thereto forming, in part, said duct, said holding means comprising opposed slot means in said walls for slidingly receiving at least one desiccant cartridge therein and for holding said desiccant cartridge in position spanning the space between said exterior linear wall and said internal wall.

6. The container of claim 5, said circulating means being between said exterior linear wall and said internal wall.

7. The container of claim 6, said circulating means comprising an electric motor and fan.

8. The container of claim 7, said motor having conductors connected thereto and extending to the exterior of said container.

9. The container of claim 5, and further comprising means for heating air located in said container between said exterior linear wall and said internal wall.

10. The container of claim 1, and further comprising means in said duct for heating air.

11. The container of claim 1, and further comprising means in said duct for removing odorous gases from air passing therethrough.

12. The container of claim 1, and in combination therewith a box in said compartment, said box having openings therein in communication with said communicating means.

13. The combination of claim 12, said box having a wall spaced from a wall of said container, said wall having openings therein, said space between said wall of said box and said wall of said container being in communication with said duct.

14. The combination of claim 12, the walls of said box being substantially adjacent, respectively, to walls of said container, said box having openings therein in communication with said communicating means.

15. The container of claim 1, and further comprising a box in said compartment, and means in said box for permitting air to circulate between the interior of said box and said duct.

16. The combination of claim 15, and a product in said box.

17. The combination of claim 16, and means for supporting said product above the bottom of said box.

18. The combination of claim 17, said supporting means comprising means permitting the passage of air beneath the said product.

* * * * *